US005692309A

United States Patent [19]

Pereira

[11] Patent Number: 5,692,309

[45] Date of Patent: Dec. 2, 1997

[54] CAN OPENER

[75] Inventor: Joseph Augustine Terence Pereira, Surrey, England

[73] Assignee: William Levene Limited, Middlesex, United Kingdom

[21] Appl. No.: 737,703

[22] PCT Filed: Mar. 21, 1995

[86] PCT No.: PCT/GB95/00642

§ 371 Date: Nov. 20, 1996

§ 102(e) Date: Nov. 20, 1996

[87] PCT Pub. No.: WO96/29276

PCT Pub. Date: Sep. 26, 1996

[51] Int. Cl.[6] ..... B67B 7/72

[52] U.S. Cl. ..... 30/417; 30/422; 30/427

[58] Field of Search ..... 30/400–410, 416–418, 30/422, 427, 440, 347; 7/152

[56] References Cited

U.S. PATENT DOCUMENTS

| | | | |
|---|---|---|---|
| Re. 27,504 | 10/1972 | Smith . | |
| 2,661,528 | 6/1953 | Coplen . | |
| 3,313,023 | 4/1967 | Jepson et al. | 30/347 |
| 3,740,840 | 6/1973 | McLaren, Jr. | 30/417 X |
| 4,734,986 | 4/1988 | Peters . | |
| 4,782,595 | 11/1988 | Diewert . | |
| 4,833,783 | 5/1989 | Davel . | |
| 5,181,322 | 1/1993 | Koo | 30/427 X |

FOREIGN PATENT DOCUMENTS

| | | |
|---|---|---|
| 0169224 | 12/1989 | European Pat. Off. . |
| 78671 | 7/1986 | Japan . |
| 112761 | 5/1989 | Japan . |
| 116189 | 7/1989 | Japan . |
| 986043 | 3/1965 | United Kingdom . |
| 1140518 | 1/1969 | United Kingdom . |
| 2107424 | 4/1983 | United Kingdom . |
| 2246756 | 2/1992 | United Kingdom . |
| 2285789 | 7/1995 | United Kingdom . |
| WO 85/03280 | 8/1985 | WIPO . |
| WO 90/05108 | 5/1990 | WIPO . |
| WO 92/02445 | 2/1992 | WIPO . |

*Primary Examiner*—Douglas D. Watts
*Attorney, Agent, or Firm*—Caesar, Rivise, Bernstein, Cohen & Pokotilow, Ltd.

[57] ABSTRACT

A can opener has two relatively pivotable body portions, one carrying a rotary cutting wheel and the other a rotary traction wheel having parallel axes, the opener being arranged to receive the rim of a can between the two wheels and to orbit the can as the traction wheel is rotated while the cutting wheel makes a peripheral cut, the traction wheel being shaped to distort the rim during cutting and the cutting wheel having an outwardly angled body portion, adjacent its cutting tip, then angled body portion being adapted to contact the outside of the rim below the cut to exert a force in the opposite direction to the traction wheel.

10 Claims, 4 Drawing Sheets

CAN OPENER

The invention relates to a can opener of the type which operates to separate an end wall or lid of the can by cutting from the outside into the upstanding rim formed at the end of the can and comprising overlapped portions of the perimeter of the end wall and the side wall of the can.

A can opener of this type is disclosed in European patent publication EP-A-169224. That opener comprises two pivotally arranged body portions, one carrying a cutter wheel and the other a traction wheel, and the rim of the can to be opened is in use of the opener received between the wheels. The axes of the wheels are substantially parallel. A problem can arise with that opener in that even when the opener has cut around the entire periphery of the rim, it can still be difficult to remove the severed end wall. It is proposed in that disclosure to provide means separate from the cutter wheel to detach the severed end wall. For this purpose the opener, in one embodiment, includes an extra release hook, and in another embodiment, a lever which distorts the side wall of the can.

In our International patent application WO 92/02445, we have shown that by appropriate shaping of the parts supporting the rim of the can, the end wall can be cut so that it may be easily detached from the can.

Accordingly in WO 92/02445 there is provided a can opener adapted to separate an end wall from a can body by cutting from the outside into the upstanding rim formed at the end of the can, the rim comprising overlapped portions of the perimeter of the end wall and the side wall of the can, the can opener comprising two body portions arranged for relative pivotal movement about an axis, one portion carrying a rotary cutting wheel and the other portion carrying a rotary traction wheel, the axes of the wheels being substantially parallel to each other (and to the main axis of the can body when in position for cutting) in one vertical plane, the opener being arranged, in use, to receive the rim of the can between the two wheels and to orbit the can as the traction wheel is rotated while the cutting wheel makes a peripheral cut into the outside of the rim, the traction wheel being shaped to distort the rim while it is cut by the cutting wheel to loosen the overlapping engagement between the end wall and the side wall of the can.

Preferably, to distort the rim, the traction wheel includes a portion having a surface adapted to engage, in use, the inner side wall of the rim, the said surface being inclined at an angle greater than the angle of the inclination of the rim with respect to the vertical axis of the can.

We have now found that further improvement in the separation of the overlapping engagement of the end wall and the side wall of the can can be achieved by a modification of the shape of the cutter wheel of the can opener disclosed in WO 92/02445.

Accordingly the present invention provides a can opener adapted to separate an end wall from a can body by cutting from the outside into the upstanding rim formed at the end of the can, the rim comprising overlapped portions of the perimeter of the end wall and the side wall of the can, the can opener comprising two body portions arranged for relative pivotal movement about an axis, one portion carrying a rotary cutting wheel and the other portion carrying a rotary traction wheel, the axes of the wheels being substantially parallel to each other (and to the main axis of the can body when in position for cutting) in one vertical plane, the opener being arranged, in use, to receive the rim of the can between the two wheels and to orbit the can as the traction wheel is rotated while the cutting wheel makes a peripheral cut into the outside of the rim, the traction wheel being shaped to distort the rim while it is cut by the cutting wheel to loosen the overlapping engagement between the end wall and the side wall of the can and the cutting wheel having an outwardly angled body portion adjacent its cutting tip, the angled body portion being adapted to contact the outside of the rim below the cut and thereby exerting a force on the rim in a generally opposite direction to that of the traction wheel.

By means of this contact the can is held in a stable position with its main axis substantially parallel to said axes of the wheels.

Although the axes of the wheels are substantially parallel in one vertical plane, the cutting head of the cutting wheel may be angled to lie at an angle, preferably of 5° to 12°, to the axes of the traction wheel and the can body in a second vertical plane.

By this means, the metal of the rim after the cut made by the cutter wheel is encouraged to separate.

Preferably the angled body portion extends around the entire perimeter of the cutting wheel.

In an especially preferred embodiment, the angled body portion ends at its lower end in a flange or shoulder around the wheel, the outer face of the flange being aligned to extend substantially parallel with the longitudinal axis of rotation of the cutting wheel. By appropriate dimensioning of the flange relative to the cutting edge of the wheel, this outer face can abut the side of a can beneath its rim during the cutting operation to stabilise the can.

Preferably, to distort the rim, the traction wheel includes a portion having a surface adapted to engage, in use, the inner side wall of the rim, the said surface being inclined at an angle greater than the angle of the inclination of the rim with respect to the vertical axis of the can.

Preferably, rotation of the traction wheel causes passive rotation of the cutter wheel.

By means of the shaping of the cutter wheel below the cutting perimeter, the can can also be more firmly maintained in the desired relationship without tendency for unwanted rotation or pivoting. The cutting wheel obtains a better bias against the can against the more rigid rim than it would against the thinner wall of the can body.

Embodiments of the invention will now be described by way of example, with reference to the accompanying diagrammatic drawings in which.

Figure 5:
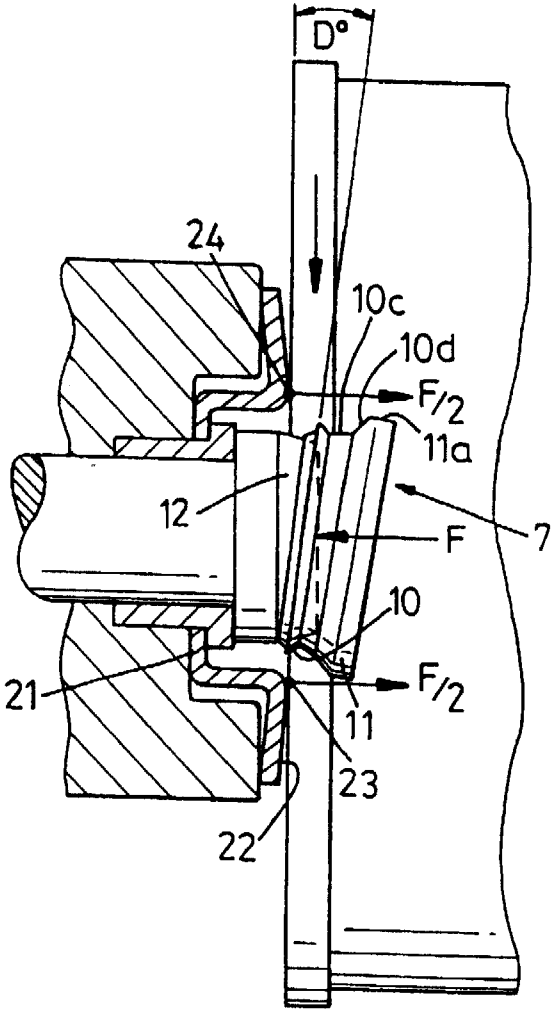
FIG. 5 is a part-sectional view along line Y—Y of FIG. 2.
Figure 6A:
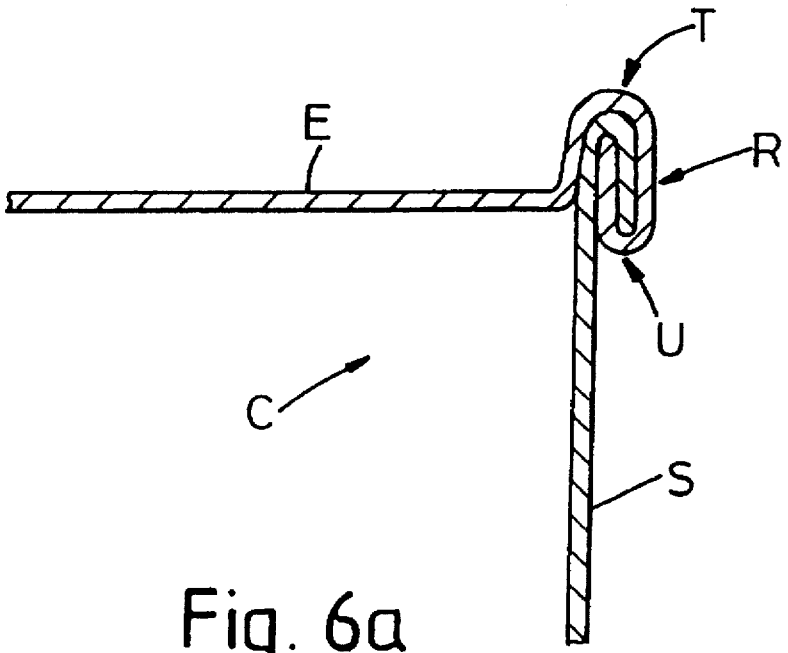
Figure 6B:
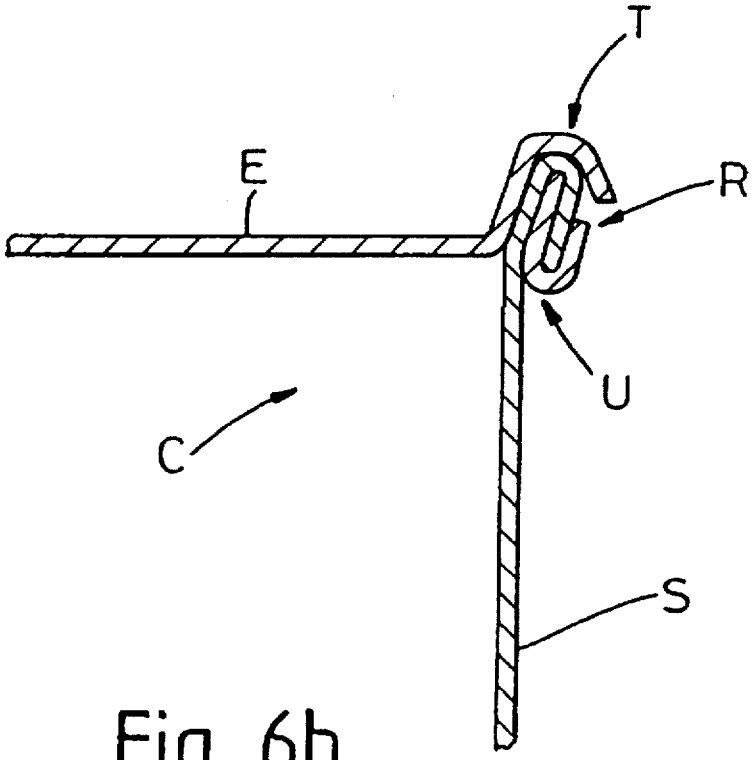

FIG. 6*a* is a partial sectional view showing a can rim before, and FIG. 6*b* is the same view after, cutting using the can opener of FIGS. 1 to 5.

The can C to be opened, as best seen in FIG. 6*a*, includes a peripheral upstanding rim R, having an upwardly facing topmost portion T and a downwardly facing underside portion U. The rim R is formed from overlapped portions of the periphery of the end wall E of the can and the end portion of the side wall S of the can.

The can opener shown in the drawings is designed to be held in one hand of a user and comprises a first body portion 1 of relatively large size having a handle portion 2, and a second relatively smaller body portion 3 having a handle grip portion 4. The two body portions 1, 3 are separately moulded of plastics. A U-shaped recess in the underside of body portion 2 contains a diecast metal insert 5 held in position by screws 6 into body 2. A spigot 7 extends from insert 5 through both body portions to join the body portions together in superimposed pivotal relation.

The two body portions of the can opener 1, 3 are pivotally movable relative to one another between a relatively closed condition, shown in the drawings, in which the handle 4 of body portion 3 lies flush against the handle 2 of the first portion 1 and a relatively open condition, not shown, in which the two handles are moved apart.

A cutter wheel 8 is rotatably mounted upon a bushing 9 within a recess 9A in the metal insert 5. The cutter wheel 7 includes an annular cutting body 10 which protrudes beyond the recess 9A, and a lowermost outwardly extending flange 11. The body 10 comprises two ramp portions 10*a* and 10*b*, FIG. 3, which converge to define the cutting edge. The portions are asymmetrical, i.e. the topmost portion 10*a* is inclined at a very shallow angle, e.g. about 5 degrees to the horizontal plane, while the lowermost portion 10*b* is inclined at a relatively steeper angle of between about 45 degrees and 65 degrees to the horizontal plane, preferably about 55 degrees. Such an arrangement has been found to give a durable cutting edge which requires minimum force to make a cut. Above the portion 10*a* the cutter wheel includes a further inclined portion 7*a* to provide a clearance between the cutter and the traction wheel, to be described later on.

Below body portion 10, the cutting wheel has a body portion 10*c* that is angled to project outwardly as it gets further from the cutting edge. The angled body portion 10*c* is joined to the above-mentioned flange 11 by a shorter, less steeply angled body portion 10*d*.

Body portion 10*c* may be formed at an angle of, for example, from 5° to 20° to the longitudinal rotational axis of the cutting wheel and body portion 10*d* at an angle of, for example, from 25° to 35° to that axis.

Flange 11 has an outer circumferential face 11*a* that extends substantially parallel to the longitudinal axis of the cutting wheel.

A traction wheel 12 includes a pin 13 which extends through the body portion 1 at its end remote from its handle portion. The pin 13 rotates within a sleeve 14. A T-shaped handle 15 is secured to the top of the pin 13 for rotating the traction wheel 12 and a circlip and spring washer arrangement 16 is present in between the lowermost face of the handle 15 and the opposing face of the first body portion 1. The traction wheel 12 comprises an inverted frusto-conical portion 17, best seen in FIG. 3.

The majority of cans currently available include a rim R having an inner face that diverges from the vertical axis of the can at an angle of about 8 to 10 degrees. We have discovered that by shaping the frusto-conical portion 17 of the traction wheel such that the rim R is bent or otherwise moved outwardly at an angle of greater than this angle during cutting, any remaining frictional engagement between the walls of the rim on each side of the cut is broken. The bending action will also tend to break any glue or like sealant present in the rim or, say, a plastics or like lining within the can. Accordingly, the angle of inclination of the portion 17 is selected to be at least greater than about 10 degrees. The maximum angle of inclination should be less than that which so bends the rim that it makes the traction wheel difficult to turn, which is of especial importance where the can opener is of the hand operated variety.

The frusto-conical portion 17 includes ribs 18 to provide grip.

Figure 4:
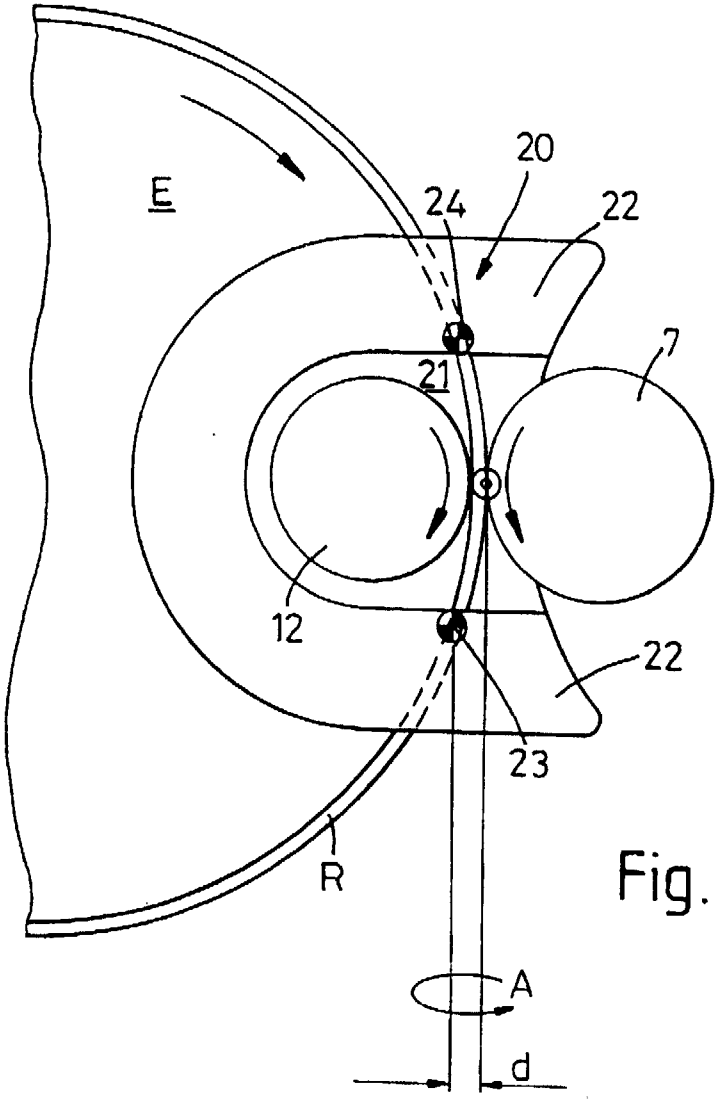
FIG. 4 is a diagrammatic illustration in plan view of a portion of the embodiment shown in FIG. 1.

Referring now to FIGS. 4 and 5, the underside of body portion 1 is provided with an abutment plate 20 of generally U-shape in plan, the central region 21 of the U-being recessed and apertured to receive the above-mentioned pin 13. Traction wheel 12 is thereby provided centrally of the 'U' and projecting a little below the lowermost plane of the 'U'.

As shown in FIG. 4, cutting wheel 7 lies partly within the open arms of the 'U' when the body portions are in the closed position and a gap d—d is provided between the two wheels to receive the rim R of a can.

Abutment plate 20, as shown in FIG. 5, defines two opposed end regions 22 being the ends of the arms of the 'U'. When a can is inserted with its rim R between traction wheel 12 and cutting wheel 7 ends 22 rest on top of the can at contact points 23 and 24 and ensure that the axis of the traction wheel is normal to the lid or end E of the can. Downward pressure by these contact points straddling the cutting point is thereby provided across the traction wheel, this being shown as reaction force $^{F}/_{2}$ at each contact point to counterbalance upward force F incurred during cutting.

However, it will be appreciated that, due to the curvature of the can, there will be a tendency for the can to tilt as shown in FIG. 4, arrow A, because of the offset d—d between forces F and F/2. Angled face 10C of the cutting wheel abuts the rim of the can to prevent this causing unwanted movement. As the abutment is against the rim rather than the thin wall of the can, this movement can be opposed without distortion of the can. By preventing the can from tilting, the rim is held in a stabilised position so that the cutting edge 10 can cut at the correct level from the top of the rim.

As shown, the longitudinal or rotational axis of the cutter wheel is inclined at an angle 'D' of about 8° to that of the traction wheel and the can body.

In use, the user initially moves the body portions to the open condition and introduces the rim R of the can C into the space between the traction and cutter wheels, i.e. cutter gap d—d (FIG. 3), and then the two body portions are moved in scissor-like fashion towards the closed condition shown in the drawings.

Figure 1:
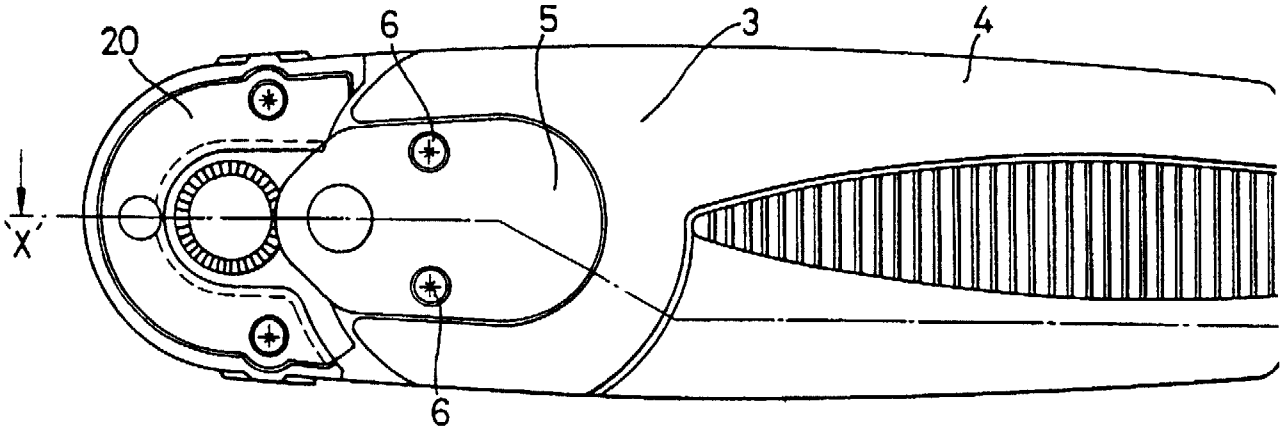
FIG. 1 is an underneath plan view of one embodiment of a can opener embodying the invention.
Figure 2:
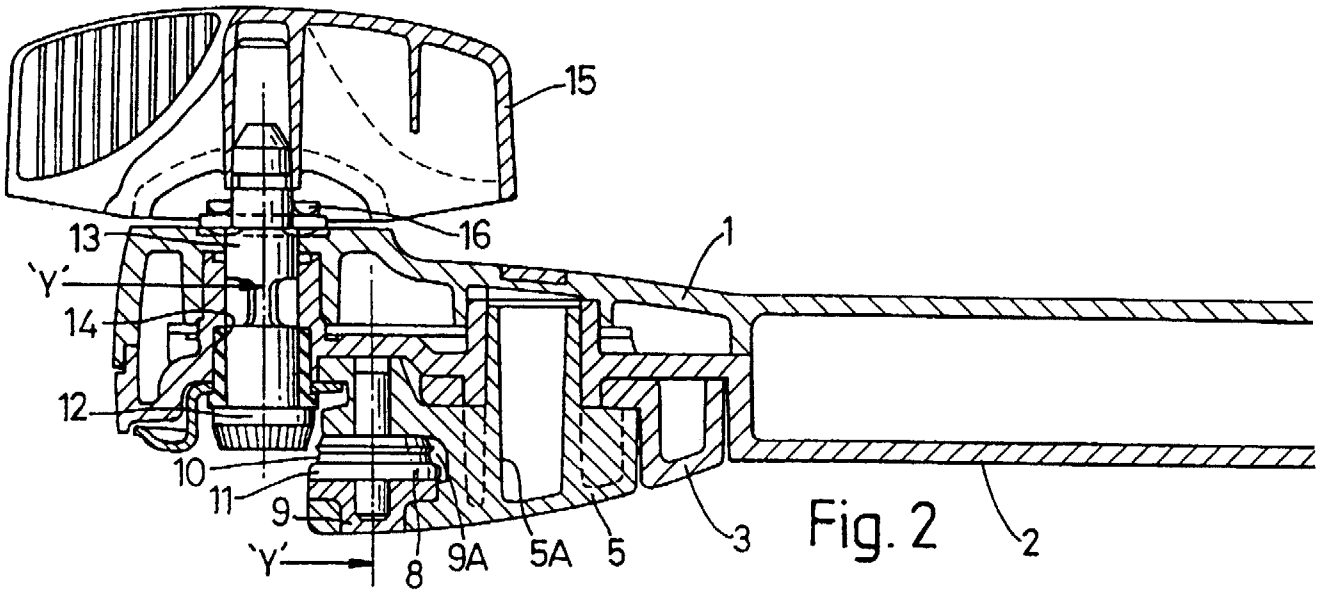
FIG. 2 is a cross-sectional view along line X—X of FIG. 1.
Figure 3:
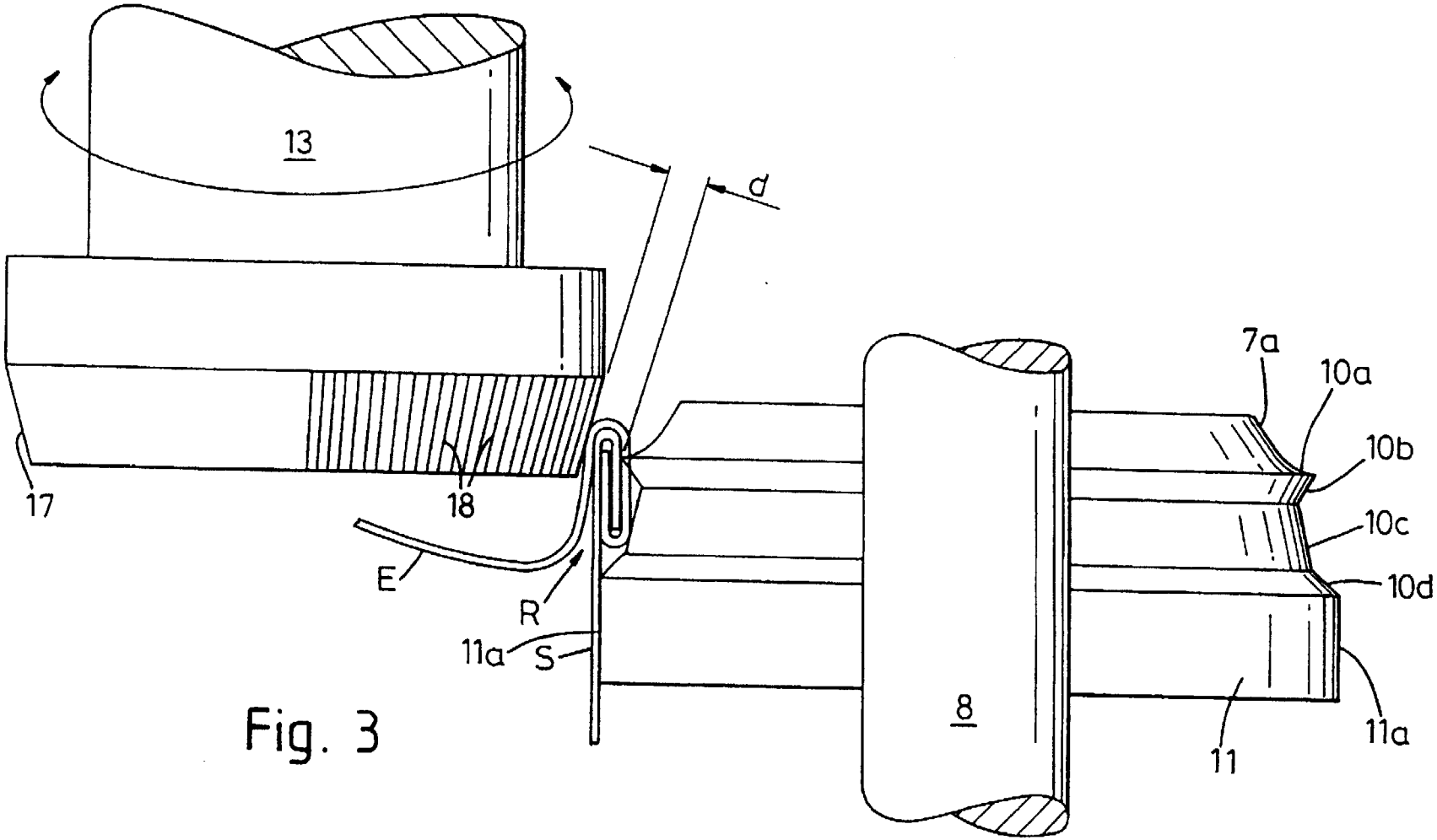
FIG. 3 is a view to an enlarged scale of part of FIG. 2, but also showing a can rim in the cutting position and showing the cutting wheel of the invention in greater detail.

As the body portions are further moved to the fully closed condition, the cutting edge 10 contacts and then cuts into an upper portion of the outside of the rim R, which is supported on its inner face by the frusto-conical portion 17, while the outside of the rim R is engaged by angled body portion 10*c* below the cut and urged inwardly thereby (FIG. 3). The meeting of the handle portions provides a lock against excess force being applied to the rim and maintain the horizontal spacing between the traction and cutter wheels at a substantially fixed distance.

As the traction wheel 12 is rotated it drives the passive cutting wheel and, because of the angle 'D', the cutting edge 10 make a spiral cut which extends vertically downwardly into the rim until the topside T of the rim is lifted away from the lower half of R by body portion 10*a*. The cutting wheel will then continue the rest of the cut, but will remain substantially parallel to the top of the rim with the cutting edge 10 tending to separate the cut edges of the end wall E and the side wall S in the manner of an agricultural ploughshare. The frusto-conical portion 17, in cooperation with the cutting edge 10, exerts a component of force outwardly and downwardly into the rim thereby to distort or bend the rim R while the opposite force applied by surface 10*c* enhances the separation effect on the cut rim. Thus the combined forces effectively hold the rim of the can in a stabilised position so that the cutting edge 10 can cut through the outer skin of R and lift the cut portion T. The opener is then removed from the can and the lid is simply pulled off by hand leaving smooth edges.

A comparison of the can rim before and after opening is shown in FIGS. 6*a* and 6*b*. As shown clearly in FIG. 6*b*, after cutting the rim has been distorted just sufficiently that the end wall E may be simply lifted from the can body by simple hand operation and without the necessity for extra tool parts.

I claim:

1. A manual can opener adapted to separate an end wall from a can body by cutting from the outside in to the upstanding rim formed at the end of the can, the rim comprising overlapped portions of the perimeter of the end wall and the side wall of the can, the can opener comprising two body portions arranged for relative pivotal movement about an axis, one portion carrying a rotary cutting wheel and the other portion carrying a rotary traction wheel, the axes of the wheels being substantially parallel to each other and to the main axis of the can body when in position for cutting, the rotary cutting wheel comprising a body having an annular cutting edge, the opener being arranged, in use, to receive the rim of the can between the two wheels and to orbit the can as the traction wheel is rotated while the cutting wheel makes a peripheral cut into the outside of the rim, a portion of the body of the cutting wheel below said cutting edge being angled to have a wall sloping outwardly and downwardly relative to the axis of the cutting wheel, whereby the angled body portion is adapted to contact the outside of the rim below the cut and exert a force opposite the traction wheel to prevent the can body from tilting when received in the can opener and to bend the rim when cut to enhance separation of the end wall.

2. A manual can opener according to claim 1, in which the cutting wheel has a cutting head and wherein the cutting head lies at an angle to the axis of the traction wheel and the can body in a vertical plane.

3. A manual can opener according to claim 2, in which the angle is from 5° to 12°.

4. A manual can opener according to claim 1, in which the traction wheel has a frusto conical portion to contact the can rim.

5. A manual can opener according to claim 1, in which the sloping wall of the body portion extends about the entire perimeter of the cutting wheel.

6. A manual can opener according to claim 1, in which the sloping wall ends at its lower end in a flange or shoulder extending around the wheel, the outer face of the flange or shoulder being aligned in use to extend substantially parallel to the longitudinal axis of the rotation of the cutting wheel.

7. A manual can opener according to claim 1, in which the cutting edge of the cutter wheel is defined by two ramp portions which converge to define the cutting edge, the portions being asymmetrical.

8. A manual can opener according to claim 7, in which the lower ramp portion is inclined to between 45° to 65° to the horizontal plane and the upper ramp portion is inclined at a shallower angle to the horizontal plane.

9. A manual can opener according to claim 1 having an abutment plate having a recessed center region between two arms; the traction wheel being mounted in the recessed center region such that respective and end regions of the arms provide contact areas for the top of the rim to ensure that the axis of the traction wheel is normal to the top of the rim when the traction wheel abuts the inner side wall of the rim and the cutting wheel cuts into the outer wall of the rim.

10. A manual can opener according to claim 9, wherein the abutment plate also has another non-recessed portion connecting the two arms to form a "U"-shape.

* * * * *